US010316705B2

(12) United States Patent
Dietel et al.

(10) Patent No.: US 10,316,705 B2
(45) Date of Patent: Jun. 11, 2019

(54) CAMSHAFT FOR THE VALVE DRIVE OF AN INTERNAL COMBUSTION ENGINE WITH A VARIABLE VALVE OPENING DURATION

(71) Applicant: ThyssenKrupp Presta TecCenter AG, Eschen (LI)

(72) Inventors: Uwe Dietel, Lichtentanne (DE); Bernd Mann, Zschopau (DE); Michael Kunz, Chemnitz (DE); Martin Lehmann, Mittelndorf (DE)

(73) Assignee: THYSSENKRUPP PRESTA TECCENTER AG, Eschen (LI)

( * ) Notice: Subject to any disclaimer, the term of this patent is extended or adjusted under 35 U.S.C. 154(b) by 79 days.

(21) Appl. No.: 15/318,950

(22) PCT Filed: Jun. 17, 2015

(86) PCT No.: PCT/EP2015/063601
§ 371 (c)(1),
(2) Date: Dec. 14, 2016

(87) PCT Pub. No.: WO2016/000965
PCT Pub. Date: Jan. 7, 2016

(65) Prior Publication Data

US 2017/0122142 A1 May 4, 2017

(30) Foreign Application Priority Data

Jun. 30, 2014 (DE) ..... 10 2014 109 103

(51) Int. Cl.
*F01L 1/344* (2006.01)
*F01L 1/053* (2006.01)
(Continued)

(52) U.S. Cl.
CPC ..... *F01L 1/34413* (2013.01); *F01L 1/047* (2013.01); *F01L 1/053* (2013.01); *F01L 1/08* (2013.01);
(Continued)

(58) Field of Classification Search
CPC ..... F01L 1/34413; F01L 1/047; F01L 1/08; F01L 2001/0473; F01L 2001/0476; F01L 13/0057; F16H 53/04
See application file for complete search history.

(56) References Cited

U.S. PATENT DOCUMENTS 2,888,837 A * 6/1959 Hellmann ..... F01L 1/08 123/90.17
5,090,366 A * 2/1992 Gondek ..... F01L 1/08 123/90.12
(Continued)

FOREIGN PATENT DOCUMENTS

CN 1942657 A 4/2007
DE 199 08 286 A1 8/2000
(Continued)

OTHER PUBLICATIONS

English translation of International Search Report for International patent application No. PCT/EP2015/063601; dated Sep. 1, 2015.
(Continued)

*Primary Examiner* — Mark A Laurenzi
*Assistant Examiner* — Wesley G Harris
(74) *Attorney, Agent, or Firm* — thyssenkrupp North America, Inc.

(57) ABSTRACT

A camshaft for a valve drive of an internal combustion engine having a variable valve opening time may include an outer shaft and an inner shaft that extends through the outer shaft, with the inner shaft being held rotatably with respect to the outer shaft. The camshaft may further include a cam
(Continued)

having a multiple-piece configuration, comprising a first part cam and a second part cam. Either the first part cam or the second part cam may be connected fixedly to the outer shaft so as to rotate with it, and the other part cam may be connected fixedly to the inner shaft so as to rotate with it. The camshaft may also include a bearing inner ring of a shaft bearing that is held on the outer shaft, with one of two second part cams comprising an axial attachment that forms at least one part of the bearing inner ring.

9 Claims, 2 Drawing Sheets

(51) Int. Cl.
*F01L 13/00* (2006.01)
*F01L 1/047* (2006.01)
*F01L 1/08* (2006.01)

(52) U.S. Cl.
CPC ... *F01L 13/0057* (2013.01); *F01L 2001/0473* (2013.01); *F01L 2001/0476* (2013.01)

(56) References Cited

U.S. PATENT DOCUMENTS

| | | | | |
|---|---|---|---|---|
| 5,253,546 | A | 10/1993 | Elrod | |
| 5,417,186 | A * | 5/1995 | Elrod | F01L 1/02 123/90.17 |
| 6,951,148 | B2 * | 10/2005 | Battlogg | F01L 1/04 123/90.16 |

FOREIGN PATENT DOCUMENTS

| | | | |
|---|---|---|---|
| DE | 10 2007 010 156 | A1 | 9/2008 |
| DE | 10 2009 056 224 | A1 | 6/2011 |
| JP | 07102914 | A | 4/1995 |
| JP | 2006144799 | A | 6/2006 |
| JP | 2013-019362 | A | 1/2013 |
| WO | 2011/032632 | A1 | 3/2011 |

OTHER PUBLICATIONS

English language Abstract for DE 199 08 286 A1 listed above.

* cited by examiner

CAMSHAFT FOR THE VALVE DRIVE OF AN INTERNAL COMBUSTION ENGINE WITH A VARIABLE VALVE OPENING DURATION

CROSS REFERENCE TO RELATED APPLICATIONS

This application is a U.S. National Stage Entry of International Patent Application Serial Number PCT/EP2015/063601, filed Jun. 17, 2015, which claims priority to German Patent Application No. DE 10 2014 109 103.5 filed Jun. 30, 2014, the entire contents of both of which are incorporated herein by reference.

FIELD

The present disclosure generally relates to camshafts for internal combustion engines.

BACKGROUND

In order for it to be possible to always operate an internal combustion engine in as optimum a manner as possible under different operating conditions, a very wide variety of methods are already known from the prior art. For instance, the variation of the valve opening duration is described in WO 2011/032632 A1. A camshaft comprises a hollow outer shaft and an inner shaft which is arranged such that it can be rotated concentrically within the outer shaft. A first part cam of a cam is mounted fixedly on the outer shaft so as to rotate with it, and a second part cam of the cam is connected fixedly to the inner shaft so as to rotate with it and is mounted rotatably on the outer shaft. The cam contour of the cam and therefore the valve opening time can be varied accordingly by way of rotation of the two-part cams with respect to one another, brought about by way of a rotation of the inner and outer shaft with respect to one another.

Each part cam requires a minimum axial installation space which is substantially as great as the installation space which a cam of a non-adjustable camshaft requires. Since, however, at least two part cams of this type are now to be provided per valve, the axial installation space which is required by the cams is increased overall.

The camshafts which are discussed here are to be distinguished fundamentally from camshafts of the type which comprise exclusively cams of the type, the contour of which is not variable. Although cams of this type can also be held variably on the camshaft, only the opening period can be shifted by way of this, but the duration thereof cannot be changed.

DETAILED DESCRIPTION

Figure 1:
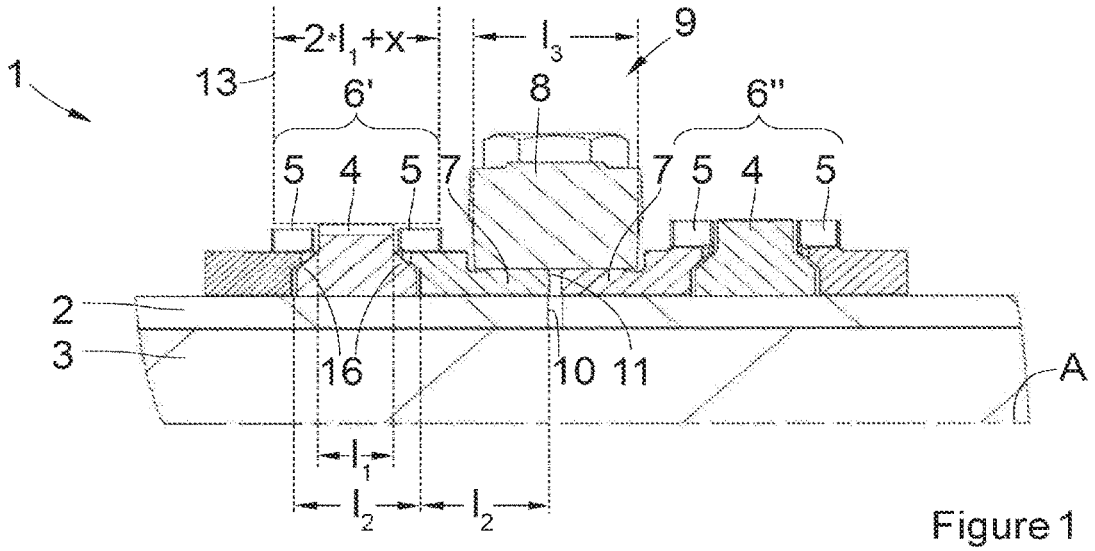
FIG. 1 is a cross sectional view through an example camshaft according to a first refinement.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

One example object of the present disclosure is to provide an improved camshaft that is distinguished by its space-saving overall design.

The camshaft according to the invention comprises an outer shaft and an inner shaft which extends through the outer shaft. The inner shaft is held rotatably with respect to the outer shaft. A cam is of multiple-piece configuration and comprises a first part cam and at least one second part cam. Either the first part cam or the at least one second part cam is connected fixedly to the outer shaft so as to rotate with it; the respectively other part cam, that is to say the at least one second part cam or the first part cam, is connected fixedly to the inner shaft so as to rotate with it. As a result, it is not important which of the part cams is connected to the outer shaft and which of the part cams is connected to the inner shaft. A bearing inner ring of a shaft bearing is held on the outer shaft. In particular, plain bearings and anti-friction bearings may be suitable as shaft bearings. According to the invention, one of the at least one second part cam then comprises an axial attachment which forms at least one part of the bearing inner ring.

The part cam then serves for the connection of the part cam and the bearing inner ring to the outer shaft. Axial installation space can be saved on account of this functional integration. This is advantageous, in particular, in the adjustable cams of the generic type, since these per se require a very large amount of axial installation space, as will still be explained in greater detail using the exemplary embodiment. Here, the part of the bearing inner ring is configured, in particular, in one piece with the second part cam. Separate fastening of the bearing inner ring to the outer shaft can be dispensed with.

The bearing inner ring is preferably of multiple-piece configuration; a further part of the bearing inner ring can be configured by way of a second part cam of an adjacent cam. A symmetrical arrangement can thus result. The two axially adjacent part cams, of in each case different cams, thus together form the bearing inner ring. Short joining paths arise from said division, which simplifies the assembly. As an alternative, the further part of the bearing inner ring can be configured by way of a single-piece cam or bearing ring which is held fixedly on the outer shaft so as to rotate with it.

An axial gap which arises between the two part cams which in each case together form a bearing inner ring is preferably oriented axially with a radial bore in the outer shaft. The gap and the radial bore can together serve as a radial lubricant channel between the inner region of the outer shaft and the bearing, in particular in the case of a plain bearing. The same applies to the alternatives which were addressed in the previous paragraph, with the result that the gap arises between a part cam and the fixed cam or the bearing ring.

In a first preferred refinement, the cam comprises a first part cam and two second part cams, the first part cam being arranged axially between the two second part cams, and one of the two second part cams forming the part of the bearing inner ring. It is particularly preferred if, in this refinement, the first part cam is connected fixedly to the inner shaft so as to rotate with it and the second part cams are connected fixedly to the outer shaft so as to rotate with it. In this case, only one part cam has to be connected fixedly to the inner shaft so as to rotate with it, in particular via a complicated pin construction.

A division of this type into three part cams is fundamentally preferred, since a driver, in particular a drag lever or rocker arm, then bears on the cam in a constantly centered manner, namely either on the inner first part cam alone, on the two outer part cams together, or on all three part cams together. In all three operating states, the forces can be transmitted to the follower in an axially central manner. However, this refinement is distinguished by a large axial installation space requirement of the three part cams, since they are all attached on the outer shaft. Here, each part cam requires a certain minimum contact area on the outer surface. Here, in particular, the middle part cam is enlarged radially to the inside, as viewed in cross section, with the result that the contact faces of the outer part cams also have to "migrate" axially to the outside. In addition, the pin construction for fixed connection to the inner shaft so as to rotate with it requires a certain minimum width. Therefore, the shoulder of the part cam always has to be longer by a certain extent, as viewed axially, than the diameter of the pin. The fact that one of the outer part cams now at the same time forms the bearing inner ring, at least partially, reduces the space requirement which is claimed by said part cam and the bearing inner ring together on the outer shaft.

In a second preferred refinement, the cam comprises precisely one first part cam and precisely one second part cam. The first part cam is arranged axially adjacently with respect to the second part cam, and the second part cam forms the part of the bearing inner ring. Although this refinement can be associated with tilting moments on the drag lever, the axial installation space which is required by the part cams can be once again reduced overall on account of the lower number of part cams.

FIG. 1 shows details of a camshaft 1 according to the invention for an internal combustion engine in cross section. The camshaft 1 comprises a hollow outer shaft 2 and an inner shaft 3 which is arranged such that it is mounted concentrically within the outer shaft 2 such that it can be rotated about a rotational angle of, in particular, at most 35°, preferably from 20° to 30°. The camshaft 1 comprises two cams 6', 6" which comprise a plurality of part cams 4, 5 which can be rotated with respect to one another. Here, the first part cam 4 is connected fixedly to the inner shaft 4 so as to rotate with it and is arranged rotatably on the outer shaft 2, whereas the second part cams 5 are held on the outer shaft 2 such that they are fixed against rotation and displacement. Here, the arrangement of the first part cam 4 such that it is fixed against rotation and displacement can be realized via conventional methods by means of a non-positive and/or a positively locking and/or integrally joined connection. The second part cam 5 is connected fixedly to the inner shaft 3 so as to rotate with it via a pin 12. Said pin 12 cannot be seen in the sectional illustration according to FIG. 1; it can still be seen in one of the following figures, however.

The two part cams 4, 5 can comprise outer contours which are identical or different from one another. The relative orientation of the outer contours of the two part cams 4, 5 with respect to one another can be set in a targeted manner using the relative rotational position between the inner shaft 3 and the outer shaft 2. If the radially elevated regions of the outer contours of the two part cams are superimposed on one another in the circumferential direction of the camshaft, the opening duration of the associated valve is reduced. If the radially elevated regions of the outer contours of the two part cams are arranged offset with respect to one another in the circumferential direction of the camshaft, the opening duration of the associated valve is increased.

The camshaft 1 is held in a housing (not shown) by means of a plain bearing 9. The plain bearing comprises a bearing outer ring 8 and a bearing inner ring 7 (multiple-piece in the case of FIG. 1).

FIG. 1 indicates a drag lever 13 using dashed lines. For interaction of the drag lever 13 with the cam 6, the drag lever always has to lie against the cam 6 on a predefined minimum contact length $l_1$. (measured parallel to the camshaft axis A), in order to limit the surface pressure to a permissible maximum value. On account of the multiple-piece configuration of the cam, however, it is possible that the drag lever 13 is in contact with only one of the part cams 4, 5. FIG. 1 shows said operating state, only the first part cam 4 being in contact with the drag lever 13 here. The maximum permissible surface pressure may not be exceeded even in a case like this. As a result, both the first part cam and the second part cams 5 together have to have in each case a minimum length $l_1$ on the outer contour. Therefore, the multiple-piece cam 6 of a variable camshaft of this type requires fundamentally considerably more axial installation space than a single-piece cam. The dimension x in FIG. 1 shows the axial free travel between the cams.

It can be seen, furthermore, that the cross section of the first part cam 4 increases conically radially to the inside, that is to say forms a type of shoulder 16. This is necessary, since each part cam requires a minimum contact area on the outer shaft and/or a certain axial length for receiving the pin 12. As a result, the space requirement on the outer shaft for contact of the part cams is increased by each part cam. Thus, each part cam requires a certain connecting length $l_2$ on the outer shaft 2, $l_2$ in this case being greater than $l_1$. Therefore, the regions of the outer part cams 5 which are in contact with the outer shaft 2 also migrate axially to the outside. In addition, the plain bearing requires a predefined plain bearing length $l_3$.

According to the invention, one of the two second part cams 5 is then configured in one piece with the bearing inner ring 7 of the plain bearing 9. It can be seen in FIG. 1 that the regions of the required contact $l_2$ of the part cam on the outer shaft 2 thus overlap with the length $l_3$ of the plain bearing 9. This results according to the invention in a space-saving arrangement in the axial direction.

In one variant, the first part cam 4 can also be the fixed part cam instead of the second part cams 5. Then, the second part cams 5 are connected fixedly to the inner shaft 4 so as to rotate with it and are arranged rotatably on the outer shaft 2, whereas the first part cam 4 is connected to the outer shaft 2 fixedly against rotation and displacement. The camshaft is then mounted via one of the adjustable part cams 5.

Furthermore, a radial bore 10 is provided in the outer shaft 2, which radial bore 10 is oriented axially with a gap 11 which results between two part cams 5 or bearing inner ring parts 7 which are arranged adjacently. By way of the bore 10 and the gap 11, a lubricant channel is formed between the plain bearing 8 and the intermediate space, radially between the outer shaft 2 and the inner shaft 3.

Figure 2:
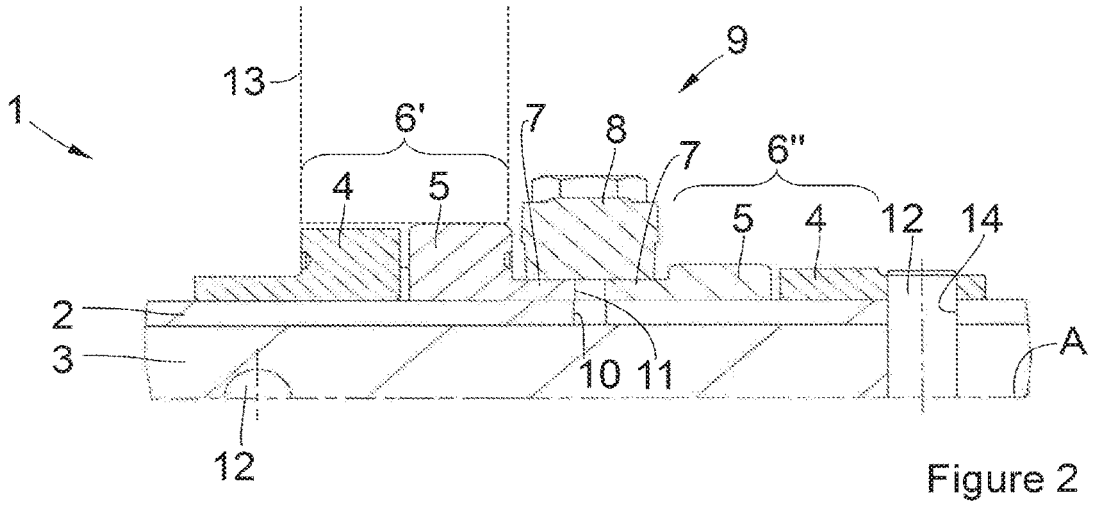
FIG. 2 is a cross sectional view through an example camshaft according to a second refinement.

FIG. 2 shows an alternative refinement which largely corresponds to the refinement according to FIG. 1. Therefore, only the differences will be discussed in the following text. The cams 6 comprise merely one second part cam 5. If, however, the drag lever 13 bears only against one of the two part cams 4, 5, tilting moments can act disadvantageously on the drag lever 13. Therefore, a refinement according to FIG. 1 is preferred, since the drag lever 13 is loaded by the cam 6 in a constantly centered manner there.

The second part cams 5 are connected fixedly to the outer shaft 2; the first part cams 4 are connected fixedly to the inner shaft 3 so as to rotate with it. For fixed connection of the inner shaft 3 to the corresponding part cam 4 so as to rotate with it, the above-addressed pin construction for fixed connection of one of the part cams to the inner shaft so as to rotate with it can be seen in FIG. 2. A pin 12 is guided in each case through a slot-shaped recess 14 which runs transversely with respect to the camshaft rotational axis A in the hollow outer shaft 2, and is connected fixedly to the inner shaft 3, in particular in a non-positive or positively locking manner. Furthermore, the pin 12 engages in a positively locking manner into that part cam which is connected fixedly to the inner shaft so as to rotate with it, in this case the part cam 4.

Figure 3:
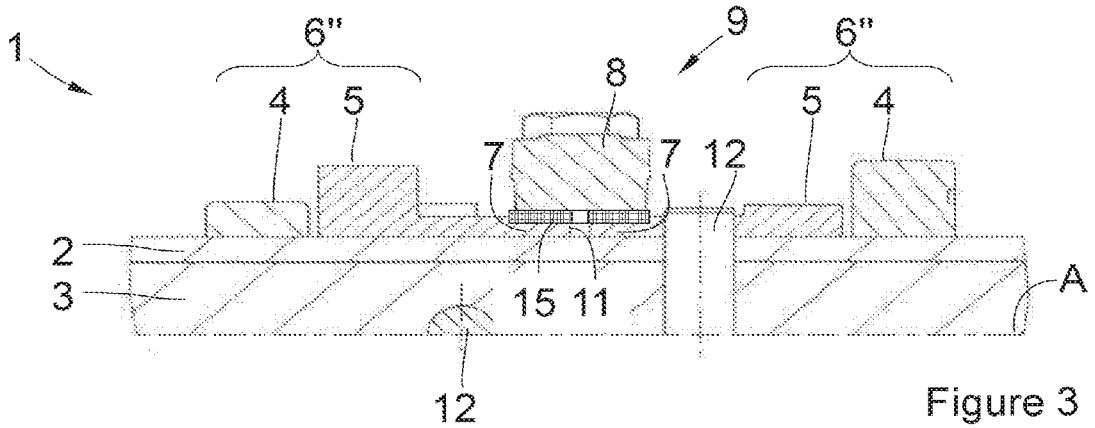
FIG. 3 is a cross sectional view through another example camshaft according to a second refinement.

FIG. 3 shows an alternative refinement which corresponds largely to the refinement according to FIG. 2. Therefore, only the differences will be discussed in the following text. The first part cams 4 are connected fixedly to the outer shaft 2; the second part cams 5 are connected fixedly to the inner shaft 3 so as to rotate with it via in each case one pin 12 in the way which has been described above.

In the refinement of FIG. 3, a separate bearing bush 15 with one or more lubricant bores is provided radially between the inner shaft 3 and the outer shaft 2. A bearing bush 15 of this type can readily also be used in the refinements according to the other figures.

Figure 4:
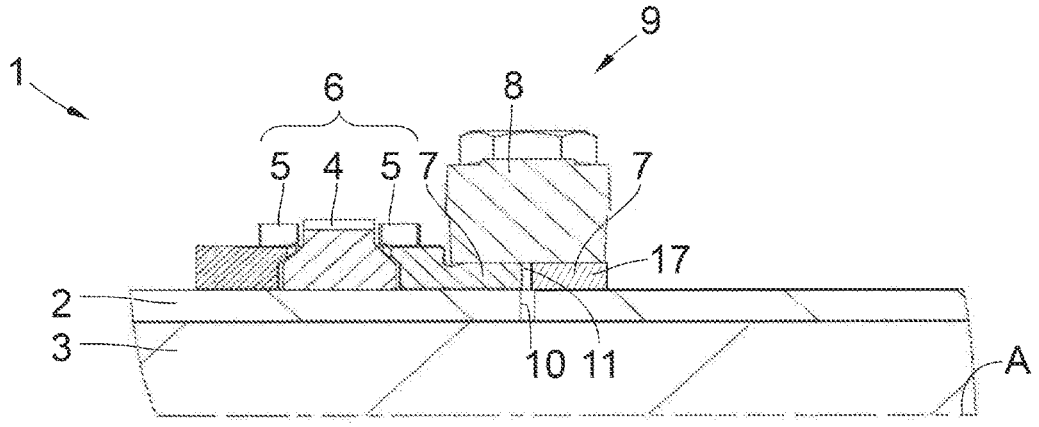
FIG. 4 is a cross sectional view through another example camshaft according to a first refinement.

FIG. 4 shows an alternative refinement which corresponds largely to the refinement according to FIG. 2. The bearing inner ring 7 is formed firstly by a part cam 5, as is also the case in FIG. 1. Secondly, the inner ring is formed by a bearing ring 17 which is separate from the part cam 5 and is not a constituent part of a cam. The gap 11 is formed between the part cam 5 and the bearing ring 17.

Figure 5:
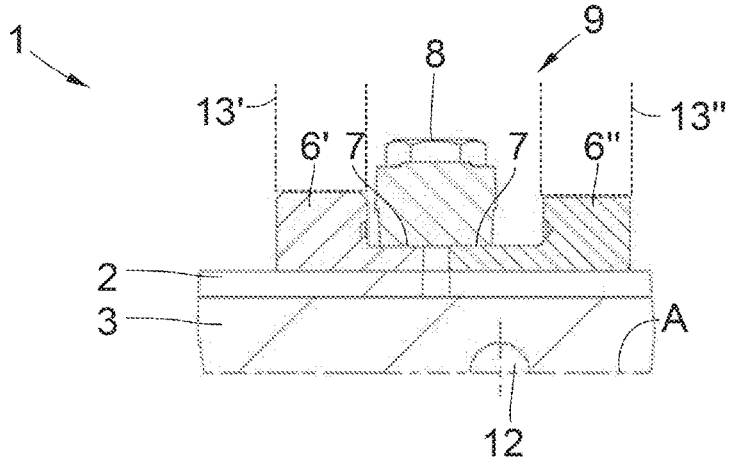
FIG. 5 is a cross sectional view through still another example camshaft.

FIG. 5 shows an alternative example. Two single-piece cams 6', 6" are shown, which are always in interaction with in each case one drag lever 13', 13" in all operating states. The two cams 6 form parts of the bearing inner ring 7. The right-hand cam 6" is an adjustable cam which is connected fixedly to the inner shaft 3 so as to rotate with it by way of the pin 12, and is held rotatably with respect to the outer shaft 2. The left-hand cam 6' is a fixed cam which is connected fixedly to the outer shaft 2 so as to rotate with it.

Figure 6:
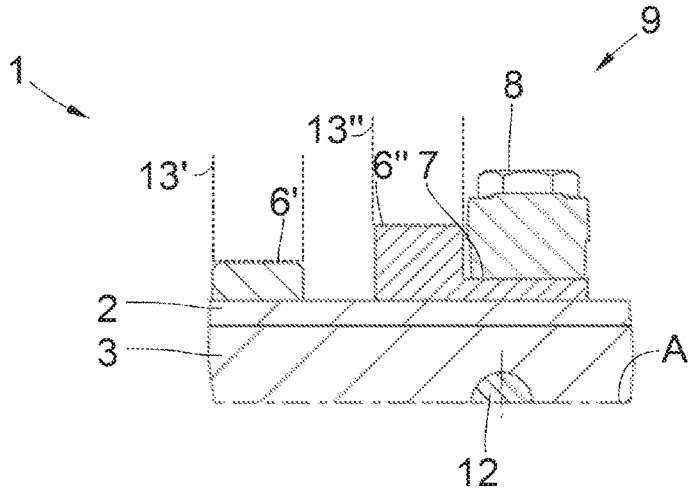
FIG. 6 is a cross sectional view through yet another example camshaft.

FIG. 6 shows another alternative example. Two single-piece cams 6', 6" are shown which are always in interaction with in each case one drag lever 13', 13" in all operating states. The right-hand cam 6" is an adjustable cam which is connected fixedly to the inner shaft 3 so as to rotate with it by way of the pin 12, and is held rotatably with respect to the outer shaft 2. Said cam completely forms the bearing inner ring 7. The lefthand cam 6' is a fixed cam which is connected fixedly to the outer shaft 2 so as to rotate with it and does not assume any function at all of the bearing 8.

A plain bearing has been shown exclusively as a bearing in the exemplary embodiments. The invention is likewise applicable in the case of anti-friction bearings. In the embodiments according to the invention in accordance with FIGS. 1 to 4, a part cam forms in each case only one part of the bearing inner ring. It is also possible, however, that a part cam completely forms the bearing inner ring.

LIST OF DESIGNATIONS

1 Camshaft
2 Outer shaft
3 Inner shaft
4 First part cam
5 Second part cam
6 Cam
7 Bearing inner ring
8 Bearing outer ring
9 Plain bearing
10 Radial bore in the outer shaft
11 Gap in the bearing inner ring
12 Pin
13 Drag lever
14 Slot-shaped recess
15 Bearing sleeve
16 Shoulder
17 Bearing ring
$l_1$ Contact length between drag lever and cam
$l_2$ Connecting length between part cam and outer shaft
$l_3$ Plain bearing length

What is claimed is:

1. A camshaft for a valve drive of an internal combustion engine having a variable valve opening time, the camshaft comprising:

an outer shaft;

an inner shaft that extends through the outer shaft, with the inner shaft being held rotatably with respect to the outer shaft;

a first cam having a multiple-piece configuration and comprising a first part cam and a second part cam, wherein either the first part cam or the second part cam is connected fixedly to the outer shaft so as to rotate with the outer shaft, wherein the one of the first part cam and the second part cam that is not connected fixedly to the outer shaft so as to rotate with the outer shaft is connected fixedly to the inner shaft so as to rotate with the inner shaft;

a bearing inner ring of a shaft bearing being held on the outer shaft, wherein the second part cam of the first cam forms at least one part of the bearing inner ring; and a second cam adjacent to the first cam, the second cam comprising a first part cam and a second part cam separate from the first part cam and the second part cam of the first cam, wherein the bearing inner ring has a multiple-piece configuration, and the second part cam of the second cam forms at least one other part of the bearing inner ring.

2. The camshaft of claim 1 wherein a gap is formed between the second part cam of the first cam and the second part cam of the second cam, which second part cam of the first cam and the second part cam of the second cam together form the bearing inner ring, wherein the gap is oriented axially with a radial bore in the outer shaft.

3. The camshaft of claim 1 wherein the first cam comprises the first part cam, and two second part cams, wherein the first part cam is arranged axially between the two second part cams, wherein one of the two second part cams forms the at least part of the bearing inner ring.

4. The camshaft of claim 1 wherein the first cam comprises the first part cam, and two second part cams, wherein the first part cam is a fixed part cam.

5. The camshaft of claim 1 wherein the first cam comprises precisely one of the first part cam and precisely one of the second part cam, the first part cam being positioned axially next to the second part cam, wherein the second part cam forms the at least one part of the bearing inner ring.

6. The camshaft of claim 1 wherein the inner shaft can rotate 20° 30° with respect to the outer shaft.

7. The camshaft of claim 1 wherein a relative rotational position between the inner and outer shafts controls an orientation of an outer contour of the first part cam with respect to an outer contour of the second part cam.

8. The camshaft of claim 1 wherein a cross section of the first part cam increases conically radially to an inside so as to form a shoulder.

9. The camshaft of claim 1 further comprising a bearing bush with one or more lubricant bores disposed between the inner and outer shafts.

* * * * *